US006174586B1

(12) United States Patent
Peterson

(10) Patent No.: US 6,174,586 B1
(45) Date of Patent: Jan. 16, 2001

(54) SURFACE TREATED SECURITY PAPER AND METHOD AND DEVICE FOR PRODUCING SURFACE TREATED SECURITY PAPER

(75) Inventor: Lars-Åke Peterson, Hultsfred (SE)

(73) Assignee: Holmen AB, Ornskoldsvik (SE)

( * ) Notice: Under 35 U.S.C. 154(b), the term of this patent shall be extended for 0 days.

(21) Appl. No.: 09/068,303

(22) PCT Filed: Oct. 29, 1996

(86) PCT No.: PCT/SE96/01384

§ 371 Date: May 7, 1998

§ 102(e) Date: May 7, 1998

(87) PCT Pub. No.: WO97/17493

PCT Pub. Date: May 15, 1997

(30) Foreign Application Priority Data

Nov. 9, 1995 (SE) ..... 9503958

(51) Int. Cl.[7] ..... B32B 3/00; B05D 5/00; B05C 1/06

(52) U.S. Cl. ..... 428/172; 428/141; 428/206; 428/211; 428/213; 427/288; 427/428; 118/244; 118/256; 118/262

(58) Field of Search ..... 428/172, 211, 428/206, 156, 187, 213, 173, 141, 325, 904.4; 162/110; 283/113, 107, 108; 118/261, 262, 236, 244, 256; 427/428, 288

(56) References Cited

U.S. PATENT DOCUMENTS

| | | | | |
|---|---|---|---|---|
| 2,482,094 | * | 9/1949 | Chavannes et al. | 264/160 |
| 4,310,573 | * | 1/1982 | Camrau | 427/356 |
| 4,591,707 | * | 5/1986 | Stenzel et al. | 234/493 |
| 5,209,953 | * | 5/1993 | Grupe et al. | 427/276 |
| 5,248,544 | * | 9/1993 | Kaule | 428/195 |

FOREIGN PATENT DOCUMENTS

| | | | |
|---|---|---|---|
| 3718452 | 1/1998 | (DE) | B41M/3/10 |
| 91/12372 | 8/1991 | (WO) | D21H/21/40 |

OTHER PUBLICATIONS

Patent Abstracts of Japan, vol. 14, No. 446, C–763, abstract of JP, A, 2–176000 (Kanzaki Paper Co. LTD), Jul. 9, 1990.

* cited by examiner

*Primary Examiner*—Donald Loney
(74) *Attorney, Agent, or Firm*—Sughrue, Mion, Zinn, Macpeak & Seas, PLLC

(57) ABSTRACT

The present invention relates to security paper (1) formed from base paper provided with a surface treatment layer on at least one side of the paper, characterized in that the layer thickness locally deviates markedly from the layer (10) thickness of the remaining dominant paper surface, and in that the local deviation forms distinctive mark (2) in the paper. The present invention also relates to a method and to a device for producing surface treated security paper.

18 Claims, 2 Drawing Sheets

SURFACE TREATED SECURITY PAPER AND METHOD AND DEVICE FOR PRODUCING SURFACE TREATED SECURITY PAPER

TECHNICAL FIELD

The invention relates to security paper formed from base paper provided with a surface treatment layer on one side or both sides thereof. Any base paper whatsoever can be used. The term surface treatment includes both surface sizing and coating, implying that the layer can be formed with a sizing agent and/or with a coating slip. The paper may also comprise two superimposed coating layers, optionally applied on top of a surface sizing layer. By security paper is meant paper that can be readily distinguished from other paper, i.e. the paper is easily recognizable.

The invention also relates to a method of producing surface treated security paper.

The invention furthermore relates to a device for producing surface treated security paper.

BACKGROUND ART

Many uncoated papers present a so called watermark, for instance in the form of the manufacturer's name or in the form of some distinctive symbol. The watermark is normally incorporated by commensurate patterning of a wire in the paper machine, for instance the wire located on the dandy roll. The watermark in the paper can be clearly seen when the paper is directed towards a light source, for instance towards a window of a room. This type of paper is one form of security paper.

The need for surface treated paper, primarily coated paper, increases from year to year. When a base paper which incorporates a watermark is coated, the watermark will be covered and hidden by the coating layer, so that the paper can no longer be easily recognized.

Many ways of marking finished paper so that something resembling watermarks appears in the paper are known to the art.

According to the international (PCT) application WO 94/07694 a chemical is applied to the paper such as to render the paper transparent over those areas in which the chemical has been applied. The chemical is applied by transferring a solution of the chemical in question via a number of rolls to a stamp means mounted on a roll that is located in the immediate proximity of another roll, and by passing the paper through the nip defined between said two rolls and therewith transfer the chemical solution from the stamp means to the paper. This chemical paper watermarking process is carried out conveniently in a printing press, either immediately before or immediately after the actual printing process.

According to the German patent specification 37 18 452 a plurality of marks are embossed mechanically in the paper and it is stated that the paper becomes transparent at the embossed locations. This process is achieved with a roll that includes a plurality of patterned elevated surfaces. A corresponding number of anvil surfaces are provided on a shaft which is spaced slightly from said elevations, said anvil surfaces having a breadth which covers the elevations on the embossment roll. The paper is introduced into the gap between the elevations and the anvil surfaces and because the gap is slightly smaller than the thickness of the paper, the pattern defined by the elevated embossments is embodied in the paper.

DISCLOSURE OF THE INVENTION

Technical problem

There is a need to be able to distinguish easily also between different refined papers. By refined paper is meant paper that is surface treated, such as paper provided with surface sizing agent layer and/or coating slip layer.

The solution

The present invention provides a solution which satisfies this need and relates to a security paper formed from base paper provided with a surface treatment layer on at least one side of the paper, characterized in that the thickness of the layer locally deviates markedly from the layer thickness of the remaining, dominant surface of the paper and in that this local deviation forms a distinctive mark of the paper.

The base paper may be any base paper whatsoever. The major part of the paper is comprised of pulp fibres, including such which are produced in a mechanical, chemi-mechanical and chemical way. The pulp may be produced from any known lignocellulosic material, including softwood and hardwood. Different pulp fibres in mixture form a usual pulp furnish. The pulps may be unbleached, semi-bleached and fully bleached, the last mentioned pulp being the dominant pulp. The paper may be based completely or partially on secondary fibres. An admixture with synthetic fibres is also feasible. The base paper contains one or more known paper chemicals in addition to pulp fibres. Certain base papers include one or more fillers.

The surface treatment layer (one or more) may be based on any appropriate slip whatsoever, including all substances from surface sizing agent to coating slip. A slip of this kind will normally contain a large number of chemicals, of which binder and pigment are the dominating chemicals. It is of advantage when the slip includes fluorescent whitening agent. The reason for this will be made evident further on in the text.

According to one embodiment of the invention, the local layer thickness is greater than the thickness of the layer on the dominant surface of the paper. For instance, the local layer thickness may be 70–130% greater than the thickness of the layer on the remainder of the paper.

According to a second embodiment of the invention, the local layer thickness is smaller than the layer thickness of the dominant paper surface. For instance, the local layer thickness may be 30–70% smaller than the layer thickness of the remainder of the paper.

According to a third embodiment of the invention, the local layer thickness may be both greater and smaller than the layer thickness of the dominant paper surface in separate positions.

It is preferred that the local deviation, i.e. the distinctive mark, will have the form of a company name and/or a company's logotype and/or a trademark. Naturally, any other form of distinctive mark which allows the paper to be easily recognized may be used. This distinctive mark need not be one and the same mark along the paper web, but it is quite feasible to use two or more different and alternating distinctive marks instead.

Naturally, the security paper may present surface treatment layers on both sides thereof, in which case local deviations in the form of distinctive marks may be incorporated in one of the surface treatment layers or in both surface treatment layers.

Light and illumination of the paper play a role in the distinctiveness of the security paper. The distinctive mark incorporated in the paper is best seen when the paper is placed over or directed towards a light source, such as a light bulb or lamp for instance.

When the local layer thickness is greater than the layer thickness of the dominant paper surface, the distinctive mark will appear as a darker colour than the remainder of the paper. The difference between the distinctive mark and the paper in general will be particularly pronounced when the layer contains fluorescent whitening agent and the light source is a lamp, which emits ultraviolet light.

It is not necessary to use a lamp in order to highlight the distinctive mark, since it suffices to direct the paper towards a window in daylight. The distinctive mark can also be highlighted by placing the paper at a given angle to ceiling lighting, i.e. not directly in line with the light source. The phenomenon may be described as a mirror effect.

When the local layer thickness is smaller than the layer thickness of the dominant paper surface, the distinctive mark will be seen as lighter in colour than the remainder of the paper.

The invention also relates to a method of surface treating a travelling paper web, wherein the paper web is caused to pass a device which includes at least one roll for applying surface treatment slip in a uniform amount along the main surface of the web, characterized in that the surface treatment slip is applied to the paper web locally and at uniform intervals in an amount which is less than and/or greater than the amount of slip applied to the main surface of the paper web leading to that said paper web presents distinctive marks.

The surface treatment slip is applied to the paper web in deviating amounts over an area which covers at most 10%, preferably at most 5%, of the total slip application area.

The surface treatment slip is applied to the dominant surface area of the paper web, i.e. excluding the local deviations, in an amount corresponding to 0.5–40 gram/m$^2$. The application of the surface treatment slip in an amount of 0.5–8 gram/m$^2$ is effected advantageously in a size (film) press and the slip may be comprised of surface sizing agent. The application of the surface treatment slip in an amount of 5–40 grams/m$^2$ is effected advantageously in a coater and the slip comprises of a coating slip.

The locally high and/or low quantities of surface treatment slip are applied to the paper web with the aid of at least one essentially smooth roll, for instance a backing roll, which presents local recess and/or local elevated surface.

Other embodiments of the method according to the invention will be described further on in the text, more specifically with reference to the explanations of the Figures.

The invention also relates to a device for surface treating a travelling paper web including at least two rolls between which the web is passed, and optionally at least one transfer roll, wherein the device is characterized in that at least one of the rolls into which the paper web comes into contact or an optional transfer roll has a plurality of recesses and/or a plurality of elevated surfaces, said recesses and/or elevated surfaces defining a distinctive mark.

In one embodiment of the device for coating a travelling paper web the device includes a coating slip pan, an applicator roll, a backing roll, a coating blade and associated blade holder connected to means for adjusting the coating blade in relation to the periphery of the backing roll, said embodiment being characterized in that the backing roll includes a plurality of recesses.

In another embodiment of the same arrangement, the backing roll includes a plurality of elevated surfaces.

More embodiments of the device will be described below with reference to the explanations of the Figures.

Advantages

The main advantage afforded by the security paper according to the invention is that a respective user of the paper is able to obtain in the paper precisely the distinctive mark desired by the user. It is well-known that various brand-name products and also other products are the subject of undesired plagiarism. The music industry is one example of industries in which unpermitted copying is common. For instance, large numbers of CDs (compact disks) are offered for sale by persons who have no right to distribute and retail the music contained on the disks. If the company that has the rights to the music concerned places a sheet of security paper (whether printed or not) in which there is incorporated a distinctive mark in the form of the company's name, for example, in the package enclosing the compact disk, the customer will be easily assured that he/she is not buying a pirate copy. As earlier mentioned, the distinctive mark in the paper can be clearly seen when the paper is placed over a conventional incandescent bulb or a UV lamp, for instance. When there is daylight, it suffices to hold the paper towards a window.

Another advantage is that the distinctive mark is produced in the paper solely with the aid of those chemicals that are normally used when surface treating paper, i.e. no additional chemicals (possibly expensive and/or environmentally detrimental) need be added.

A third advantage is that both the method and the apparatus setup (the device) deviate only slightly from already established and well-functioning techniques, and hence the cost of producing the security paper will not be unduly increased.

BEST EMBODIMENT

All three categories of the invention will be described below with reference to the Figures and furthermore a number of trials associated with the production of security paper in accordance with the invention are described.

Figure 1:
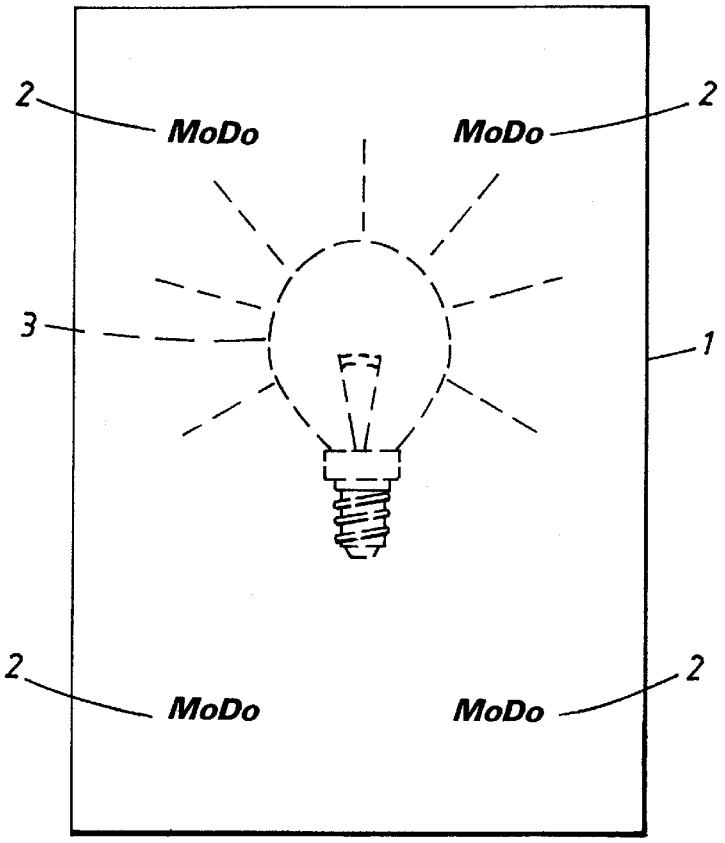
FIG. 1 shows a security paper according to the invention placed over a conventional incandescent lamp.

FIG. 1 illustrates an A4-sheet of security paper 1 according to the invention. The paper presents four distinctive marks 2 in the form of a logotype, more specifically "MoDo". Naturally, the number of distinctive marks on each A4 sheet may be fewer or greater than four. The security paper 1 is placed over a conventional incandescent bulb 3. The bulb 3 may be screwed into a lamp base and be otherwise uncovered or the bulb and the lamp base can be housed in a box with, e.g., a glass sheet placed above the bulb 3. If the security paper 1 is placed on the glass sheet mentioned, the four distinctive marks 2 will be highlighted in the manner shown. The contrast between the four distinctive marks 2 and the remainder of the paper surface will not normally be as pronounced as that in the Figure. (For instance, with regard to contrast the Figure is changed when copying the original Figure). The reason why a contrast appears, i.e. why the distinctive marks 2 appear darker in colour to the remainder of the paper surface, is because the local layer thickness is greater than the remaining layer thickness, i.e. of the dominant paper surface. Said layer is formed from a traditional coating slip, for instance. This slip may include or lack a fluorescent whitening agent. When the coating slip contains fluorescent whitening agent, a clear contrast is obtained between the distinctive marks and the paper sheet in general when a UV lamp is used instead of a conventional incandescent bulb.

Any distinctive mark can be incorporated in the security paper according to the invention. For instance, when the customer is a music company selling, for instance, CDs, it is appropriate for the distinctive mark to be in the form of the company's name or in the form of an abbreviation of the company's name. A CD is normally much smaller than an A4-sheet and the area of the CD packet or envelope will be smaller than the area of an A4-sheet. Since paper can be readily converted, all that is needed is to cut the paper to a size in which it can be fitted into the packet and which incorporates as determined by the company a predetermined number of distinctive marks. When the packeted CD is sold to a customer, the salesman need only remove the paper from the packet and place the paper on a glass sheet covering an illuminated bulb and therewith show the purchaser that the product is genuine by virtue of the company name being clearly seen on the paper, for instance. Alternatively, the purchaser himself can carry out the mentioned check. The security paper concerned need not be provided with any other form of information (e.g. printed information), although the provision of information may be advantageous. It is preferred that the distinctive mark itself, i.e. a most limited part of the paper, is free from covering information.

Naturally, the security paper is not restricted to the aforesaid sizes, but can vary widely with regard to size and the size of the paper being determined by the customer, i.e. the purchaser of security paper.

A large variety of brand goods are sold each day, such as clothings, for instance. Those clothings are normally provided with some form of symbol or a trademark which guarantees the origin of the garment in question. However, there are people in the trade who do not hesitate to manufacture garments themselves and copy a well-known symbol for instance, and then sell the garment as the genuine article. This plagiarism can be made more difficult to achieve and possibly also be prevented by including the security paper according to the invention in the package when packaging the genuine article. The security paper according to the invention can also be used advantageously in data manuals and as starting material in the production of lottery tickets. Because the paper manufacturer checks that its customers are serious customers and sells its paper solely to authentic customers, the forgers are presented with a further difficult nut to crack in pursuing their activities.

Figure 2:
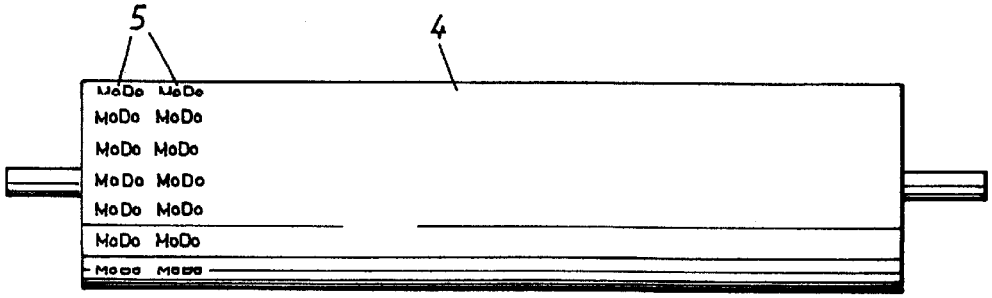
FIG. 2 shows a backing roll forming part of a device according to the invention.

FIG. 2 illustrates a backing roll 4 forming part of a device according to the invention, for instance in a so-called blade coater. Such a backing roll 4 may have a length of 3200 mm and a diameter of 800 mm. The backing roll 4 is normally comprised of a metal core and an external covering of rubber or rubber-like material (e.g. special plastics) of given thickness. The initially smooth mantle surface (e.g. of rubber) has provided therein a given number of recesses 5 which form the distinctive mark, in this case "MoDo". The depth of the recesses 5 may be varied, e.g. within the range of 0.1–1 mm. The recesses 5 are produced with the aid of some form of tool. The aforedescribed method of procedure is suitable in the case of the individual coating device in which the original backing roll is completely smooth. Naturally, the roll may be provided with the recesses 5 from the very beginning, i.e. when the roll is manufactured and the rubber mantle moulded firmly to the metal core (or affixed thereto in some other way).

Instead of recesses 5, the roll may be provided with corresponding elevated surfaces. When the backing roll is initially completely smooth, the elevated surfaces can be applied to the roll in the form of two-sided adhesive tape configures to form a distinctive mark, e.g. "MoDo". The elevated surfaces may have a thickness corresponding to the aforedescribed recesses 5, i.e. thicknesses within the range of 0.05–1 mm. The roll may alternatively be provided with such elevated surfaces from the very beginning, i.e. in the manufacture of the roll, wherein the elevated surfaces may also consist of rubber, for instance, and be intact with the remainder of the material.

Figure 3:
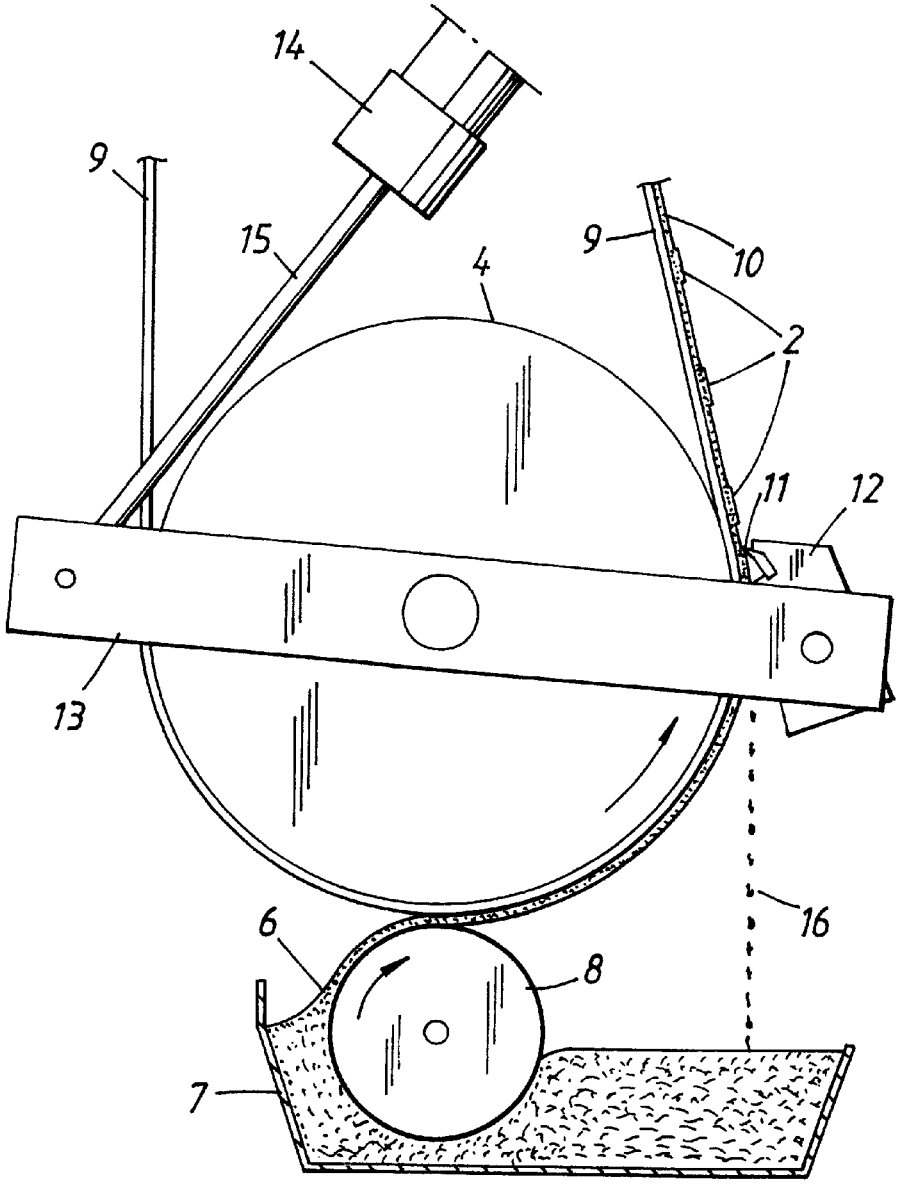
FIG. 3 shows a device for use when carrying out a method according to the invention.

FIG. 3 illustrates a known blade coating apparatus. The only difference between the illustrated apparatus and a conventional apparatus is that the backing roll 4 has a large number of recesses 5 (not shown in FIG. 3, but shown in FIG. 2).

Coating slip 6 is delivered to a container or a pan 7. A rotating applicator roll 8 entrains a layer of slip 6, the major part of which is transferred to and adheres to one side of the travelling paper web 9. The final or concluding thickness of the coating layer 10 is determined by the coating blade 11, which lies against the newly supplied coating layer. The coating blade 11 is mounted in a blade holder 12 carried by a pivotal arm 13. The placement of the coating blade 11 along the periphery of the backing roll 4 and the paper web is governed by an hydraulic cylinder 14 and an axially adjustable shaft 15 projecting from the cylinder 14. The shaft 15 is rotatably mounted in the arm 13 and the blade holder 12 is adjustably mounted on the other end of said arm. The blade angle can be set by means of the blade holder 12.

By the method according to the invention the paper web 9 is pressed slightly inwards on the surfaces that lie adjacent the recesses 5 such that as the web passes the blade 11, this inward pressing of the web will result in the thickness of the coating layer on said surfaces being greater than the thickness of the coating layer in general 10, wherewith the coated travelling paper web will include scarcely discernable elevated surfaces that define the distinctive marks 2. Surplus 16 of the coating slip 6 falls down into the pan 7.

The paper web 9 coated with layer 10 is then passed to one or more drying stations, so that a final product of desired dry solids content is obtained. If a customer desires calendared paper, the paper can be calendared without the distinctive marks 2 disappearing. It is possible that the elevated surfaces will be flattened, although the distinctive marks 2 will still clearly be seen when light is shone through the security paper. When wishing to provide also the other side of the paper web 9 with a coating layer that incorporates the distinctive mark, the web 9 is passed again through a coating apparatus similar to that shown in FIG. 3, but with the uncoated side facing towards the applicator roll 8.

Although the method according to the invention has been illustrated in FIG. 3 with respect to blade coating, it will be understood that the method can also be applied with roll-raker coating and air-brush coating. In principle, these two coating methods function in the same way as the blade coating method. The only difference is that in the former case a roll-raker is used to rake away excessive slip, while in the latter case an air jet is used to this end.

By the methods described up to now the coating layer does not come into direct contact with the roll 4 in which recesses 5 have been formed. However, the method according to the invention can also be applied in conjunction with so-called roll coating, wherein at least one of the rolls includes such recesses and in which the recesses are filled with coating slip. The recesses may be provided in a roll that has direct contact with the paper web as it passes the nip between two rolls, or can be provided in a transfer roll from which a slip layer exhibiting local deviations is transferred to the roll that comes into contact with the paper web in the manner described. The recesses can be formed on both rolls that define the nip through which the paper web is caused to pass. In these cases, the security paper incorporates distinctive mark in each coating layer, i.e. on both sides of the paper.

The method can also be applied in so-called size(film) presses having two mutually opposing rolls that define therebetween a nip through which the paper web is caused to pass.

EXAMPLE 1

A starting paper having a grammage of 83 grams/m$^2$ was manufactured in a paper mill. The pulp furnish comprised 60% birch sulphate pulp fibres having a brightness of about 89% ISO and 40% pine sulphate fibres having a brightness of about 90% ISO. Starch, hydrophobizing agent, retention agent and shading pigment were added as paper chemicals. Furthermore filler in the form of chalk (Hydrocarb 65) was added. 30% reject of the same paper type was added to the pulp furnish, calculated on 100% of the aforesaid fresh fibres.

The paper was coated on both sides with a slip in an amount corresponding to 7 grams/m$^2$, meaning that the finished base paper had a grammage of 97 grams/m$^2$. The slip comprised 100 parts chalk (calcium carbonate in a given form) with the remainder comprised of starch, latex and fluorescent whitening agent. The coating was carried out in a size(film)press of the SYM-SIZER type.

This base paper was passed to a coater having two coating units in total, of which one was similar to the coating unit shown in FIG. 3.

The coating slip 6 applied to one side of the double sided precoated paper 9 comprised of:

| | |
|---|---|
| 50 | parts calcium carbonate (in the form of HC 90) |
| 48 | parts clay (of the Supraflex 80 type) |
| 2 | parts plastic pigment (in the form of Ropaque HP 91) |
| 1.6 | parts caboxymethyl cellulose |
| 12 | parts latex |
| 0.02 | parts shading pigment (of the Levanyl type) |
| 0.3 | parts hardener (of the Urecoll type) |
| 0.7 | parts fluorescent whitening agent (of the Blankophor type) |

The backing roll 4 was provided with a large number of recesses 5 defining the logotype "MoDo". The recesses 5 had a depth of 0.2 mm. The coating slip 10 was applied to the dominant surface of the paper in an amount corresponding to 16 grams/m$^2$. It was estimated that slip was applied to the distinctive mark areas 2 in an amount corresponding to 30 grams/m$^2$. The same coating slip as that described above was applied to the whole of the other side of the paper web 9 in the other conventional coating unit in an amount corresponding to 16 grams/m$^2$. The coating rate was about 700 meters/min. The finally coated and dried paper had a grammage of 130 grams/m$^2$. The trial took about one hour to complete.

The finished paper was supercalendared and then cut into sheets of A4-size to obtain security paper 1 in accordance with the FIG. 1 illustration.

The distinctive marks 2 were clearly visible when illuminating the paper sheet 1 (and resembled watermarks on uncoated paper). It was also possible to see the distinctive marks 2 in the "mirror" of the paper surface facing a light source.

This trial run shows that security paper according to the invention can be readily produced under normal paper coating operating conditions, including the coating rate.

EXAMPLE 2

The aforedescribed trial run was repeated in an identical fashion with the sole difference that the backing roll 4 was provided with elevated surfaces instead of recesses 5. The elevated surfaces were formed to provide the distinctive marks "MoDo", using to this end adhesive tape which was fastened to the smooth rubber mantle surface of the backing roll 4 to provide elevated surfaces having a height of 0.07 mm.

16 grams/m$^2$ of coating slip were applied to both sides of the paper web also in this case. Because of the elevated surfaces on the backing roll 4, the coating slip was scraped off on those surfaces that formed the distinctive marks such as to reduce the applied layer to only about 8 grams/m$^2$.

In the case of this embodiment of the invention, the distinctive mark in the security paper appears lighter than the remainder of the paper when the paper is illuminated or irradiated in the aforedescribed manner.

This trial run was also effected in the absence of any disturbance.

The method according to the invention has been found to function well at different coating rates, more specifically coating rates from about 350 meters/minute up to about 900 meters/minute. Successful trials have also been carried out with paper of different grammages, including grammages on both sides of the aforesaid grammage.

What is claimed is:

1. A security paper comprising a base paper having a coextensive surface treatment layer, which surface treatment layer contains at least one distinctive mark therein, on at least one side of the paper, said surface treatment layer being substantially of a uniform thickness, and having a thickness deviating from said uniform thickness for forming said at least one distinctive mark therein, said base paper and coextensive surface treatment layer forming a security paper.

2. A security paper according to claim 1, characterized in that the deviating thickness is greater than the uniform thickness of the surface treatment layer.

3. A security paper according to claim 1, characterized in that the deviating thickness is smaller than the uniform thickness of the surface treatment layer.

4. A security paper according to claim 1, characterized in that the deviating thickness is both greater and smaller than the uniform thickness of the surface treatment layer in separate positions thereon.

5. A security paper according to claim 1, 2, 3 or 4, characterized in that the distinctive mark has the form of a company name and/or a company logotype (2) and/or a trademark.

6. A security paper according to claim 1, characterized in that the paper has a surface treatment layer on both sides thereof.

7. A security paper according to claim 6, characterized in that each surface treatment layer incorporates at least one distinctive mark.

8. A method of surface treating a travelling paper web, wherein the paper web is caused to pass a device which includes at least one roll for applying a surface treatment slip on the entire area of the paper web and extending along the main surface area of the paper web in one and the same applying amount, characterized by applying the surface treatment slip locally to the paper web at uniform intervals there along in an amount smaller than and/or greater than the amount applied to the main surface of the paper web thereby providing on the paper web at least one distinctive mark.

9. A method according to claim 8, characterized by applying the surface treatment slip to the paper web in deviating amounts on a surface which covers at most 10%, of the total slip applying surface.

10. A method according to claim 8, characterized by applying the surface treatment slip to the paper web in deviating amounts on a surface which covers at most 5% of the total slip applying surface.

11. A method according to claim 8, 9 or 10, characterized by applying the surface treatment slip to the main surface of the web in an amount corresponding to 0.5–8 grams/$m^2$, and by applying said slip in a size(film)press.

12. A method according to claim 11, characterized in that the surface treatment slip is comprised of any sizing agent whatsoever.

13. A method according to claim 8, 9 or 10, characterized by applying the surface treatment slip (6) to the main surface of the paper web in an amount corresponding to 5–40 grams/$m^2$, and by applying said slip in a coater.

14. A method according to claim 13, characterized in that the surface treatment slip is comprised of any coating slip whatsoever.

15. A method according to claim 8, characterized by applying the locally high and/or low quantities of surface treatment slip to the paper web with the aid of at least one essentially smooth roll, for instance a backing roll which has local recess and/or local elevated surface.

16. An apparatus for surface treating a travelling paper web in a coextensive manner with a surface treatment layer including at least two rolls between which the paper web is moved and optionally at least one transfer roll, characterized in that at least one of the rolls with which the paper web comes into contact or an optional transfer roll presents a plurality of recesses and/or a plurality of elevated surfaces, said recesses and/or elevated surfaces defining at least one distinctive mark.

17. An apparatus according to claim 16 for coating a travelling paper web including a coating slip pan, an applicator roll, a backing roll, a coating blade and associated blade holder connected to means for adjusting the coating blade in relation to the periphery of the backing roll, characterized in that the backing roll presents a plurality of recesses.

18. An apparatus according to claim 16 for coating a travelling paper web pan, an applicator roll, a backing roll, a coating blade and associated blade holder connected to means for adjusting the coating blade in relation to the periphery of the backing roll, characterized in that the backing roll presents a plurality of elevated surfaces.

* * * * *